US006097341A

United States Patent [19]

Saito

[11] Patent Number: 6,097,341

[45] Date of Patent: Aug. 1, 2000

[54] STRUCTURE OF AN ANTENNA FOR A PORTABLE RADIO COMMUNICATION APPARATUS

[75] Inventor: Tetsuya Saito, Saitama, Japan

[73] Assignee: NEC Corporation, Tokyo, Japan

[21] Appl. No.: 09/072,689

[22] Filed: May 6, 1998

[30] Foreign Application Priority Data

May 7, 1997 [JP] Japan ..... 9-117296

[51] Int. Cl.[7] ..... H01Q 1/36

[52] U.S. Cl. ..... 343/702; 343/895

[58] Field of Search ..... 343/702, 700 MS, 343/846, 895

[56] References Cited

U.S. PATENT DOCUMENTS

| | | | |
|---|---|---|---|
| 5,343,213 | 8/1994 | Kottke et al. | 343/702 |
| 5,504,494 | 4/1996 | Chatzipetros et al. | 343/702 |
| 5,764,191 | 6/1998 | Tsuda | 343/702 |
| 5,835,065 | 11/1998 | Wallace et al. | 343/702 |
| 5,861,859 | 1/1999 | Kanayama et al. | 343/702 |

FOREIGN PATENT DOCUMENTS

| | | |
|---|---|---|
| 0 613206 | 8/1994 | European Pat. Off. . |
| 0 634 806 | 1/1995 | European Pat. Off. . |
| 0 734 092 | 9/1996 | European Pat. Off. . |
| 0 772 255 | 5/1997 | European Pat. Off. . |
| 5-343907 | 12/1993 | Japan . |
| 6-216630 | 8/1994 | Japan . |
| 7-235820 | 9/1995 | Japan . |
| 7-273524 | 10/1995 | Japan . |
| 8-204420 | 8/1996 | Japan . |
| 8-316724 | 11/1996 | Japan . |
| 98/08267 | 2/1998 | WIPO . |

OTHER PUBLICATIONS

Japanese Patent Application No. 7–122917, published May 12, 195. (It is noted in the Search Report that U.S. Patent No. 5,691,730 is an equivalent).

*Primary Examiner*—Don Wong
*Assistant Examiner*—James Clinger
*Attorney, Agent, or Firm*—Sughrue, Mion, Zinn, Macpeak & Seas, PLLC

[57] ABSTRACT

An antenna structure for a portable radio communication apparatus of the present invention includes a whip antenna and a helical antenna feed portion connected by capacitive coupling via an insulator. When the whip antenna is extended, the electric length can be adjusted on the basis of the amount of capacitive coupling between a straight portion and the helical antenna feed portion, i.e., without resorting to the adjustment of a helical antenna element. When the whip antenna is retracted, the straight portion is electrically isolated in order to allow the helical antenna element to operate alone. In this position, the helical antenna element is optimally adjusted in order to resonate in a desired frequency band.

2 Claims, 8 Drawing Sheets

STRUCTURE OF AN ANTENNA FOR A PORTABLE RADIO COMMUNICATION APPARATUS

BACKGROUND OF THE INVENTION

The present invention relates to the structure of an antenna for a portable radio communication apparatus and capable of achieving a desirable characteristic in both of the extended position and retracted position of a whip antenna thereof.

An antenna for use in a portable radio communication apparatus should preferably be made up of a whip antenna having an electric length of $\lambda/2$ (½ wavelength) and a helical antenna or similar miniature antenna. While conversation is held on the radio communication apparatus, the whip antenna is used in order to reduce body deterioration. In the stand-by condition of the radio communication apparatus, the helical antenna is used so as not to degrade portability. It has been customary with a portable radio communication apparatus to combine a retractable whip antenna and a helical antenna such that the whip antenna operates when it is extended or the helical antenna operates when the whip antenna is retracted.

A decrease in the size of a portable radio communication apparatus has made it difficult to provide a whip antenna with an electric length of $\lambda/2$. A helical antenna may be coaxially connected to the tip of a whip antenna in order to implement the electric length of$\lambda/2$ (½ wavelength) and reduce body deterioration. For example, Japanese Patent Laid-Open Publication Nos. 5-343907 and 6-216630 teach a variable length whip antenna and a retractable whip antenna, respectively. Further, Japanese Patent Laid-Open Publication No. 7-273524 proposes an antenna having a fixed helical antenna having a ¼ wavelength.

In each of the conventional antenna structures, the whip antenna and helical antenna are connected to each other. This brings about a problem that when the whip antenna is retracted, the resonance frequency of the helical antenna and corresponding impedance matching condition cannot be optimally adjusted due to the influence of the whip antenna. To conventionally solve this problem, adjustment is made in consideration of balance between the extended position and the retracted position of the whip antenna. This kind of adjustment, however, prevents the whip antenna and helical antenna from fully utilizing their individual characteristics. Moreover, the power transfer efficiency is lowered due to an increase in input impedance. In addition, the adjustment of the helical antenna taking account of the above noted balance prevents the helical antenna to be optimally adjusted in the retracted position of the whip antenna, degrading the radiation efficiency in the retracted position.

A problem with the variable length whip antenna is that in the retracted position not all power is fed to the helical antenna because the feed relies on capacitive coupling, lowering the radiation efficiency in the retracted position.

In all of the conventional variable length whip antenna, retractable whip antenna and antenna with a fixed ¼ helical antenna, not all power output from the helical antenna, which plays the role of a matching circuit between the whip antenna and a radio circuit, can be transferred to the whip antenna. As a result, the helical antenna adjoining a feed portion operates as an antenna and radiates. This prevents the whip antenna from achieving an expected radiation efficiency and therefore an expected optimized characteristic alone.

SUMMARY OF THE INVENTION

It is therefore an object of the present invention to provide the structure of an antenna for a portable radio communication apparatus capable of achieving a desirable radiation efficiency in both of its extended position and retracted position and therefore a designed optimal antenna characteristic.

A structure of an antenna for a portable radio communication apparatus of the present invention includes a whip antenna retractably mounted on the casing of the radio communication apparatus and including a rod-like straight portion, a helical antenna feed portion positioned on the tip portion of the whip antenna, and a helical antenna connected to the helical antenna feed portion. The whip antenna and helical antenna feed portion are coupled by capacitive coupling via an insulator.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENTS

Figure 1:
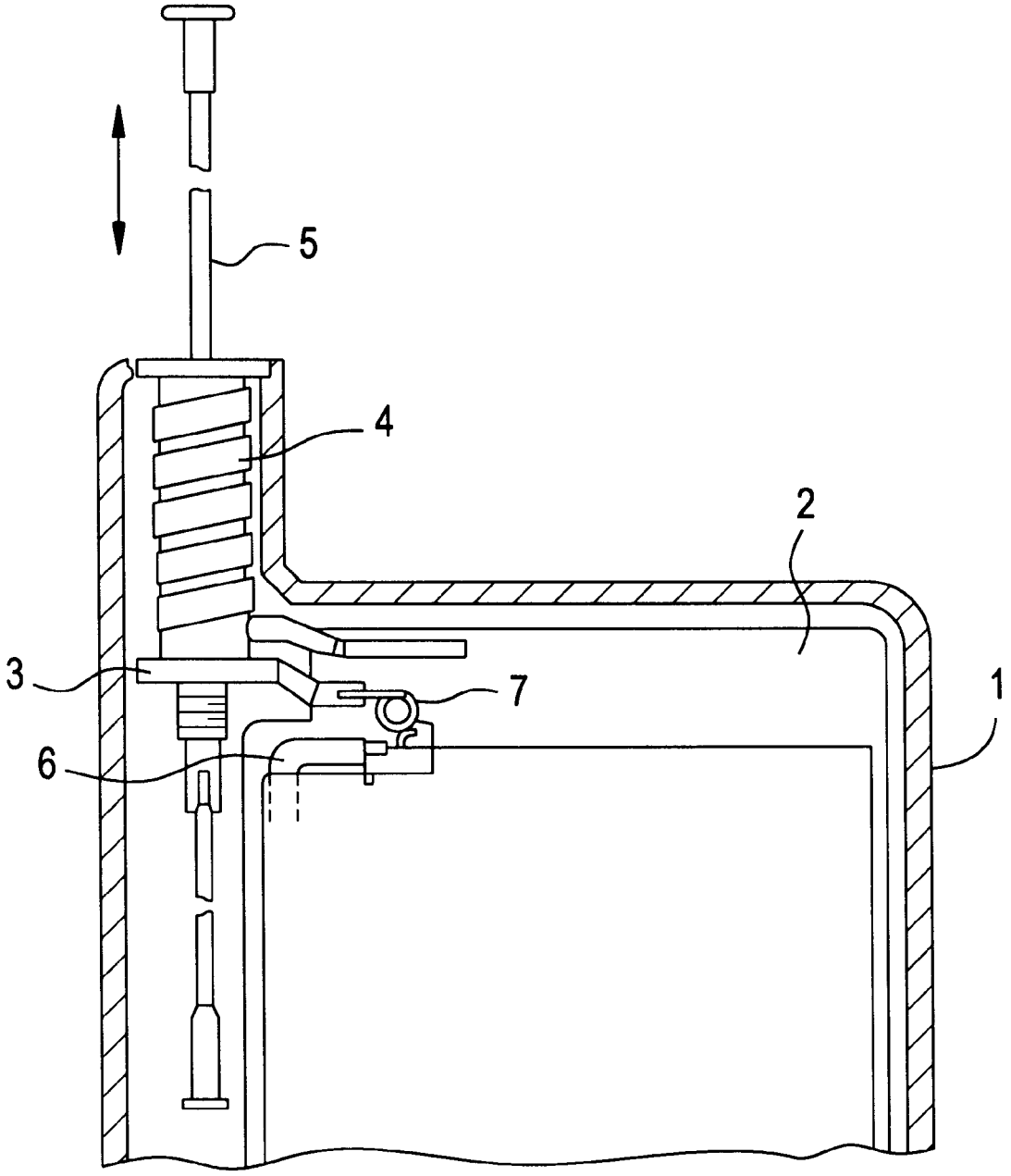
FIG. 1 PRIOR ART
FIG. 1 is a section showing a conventional variable length whip antenna.

To better understand the present invention, brief reference will be made to a conventional variable length whip antenna, shown in FIG. 1. The whip antenna to be described is taught in Japanese Patent Laid-Open Publication No. 5-343907 mentioned earlier. As shown, the whip antenna is mounted on a casing 1 included in a portable telephone. A printed circuit board 2 is disposed in the casing 1 and loaded with a transmitter/receiver. An antenna holder 3 is formed of metal and connected to a foil pattern formed on the circuit board 2. A helical antenna element 4 is also connected to the foil pattern. A retractable whip antenna element 5 extends throughout the helical antenna element 4 coaxially with the element 4. There are also shown in FIG. 1 a coaxial feeder 6 and a matching coil 7.

When the whip antenna element 5 is extended outward of the casing 1, power is fed to the element 5. When the whip antenna element 5 is retracted into the casing 1 deeper than the helical antenna element 4, power is fed to the element 4 by capacity coupling.

Figure 2A:
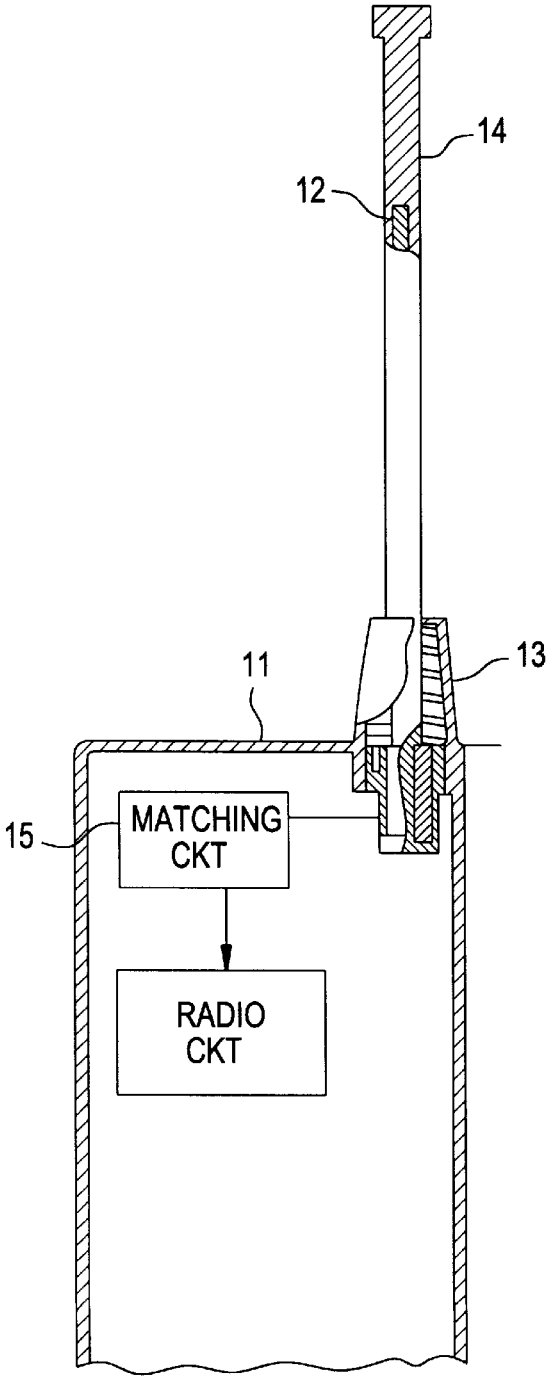
FIG.2A PRIOR ART
FIG. 2A is a section showing a conventional retractable whip antenna in its extended position.
Figure 2B:
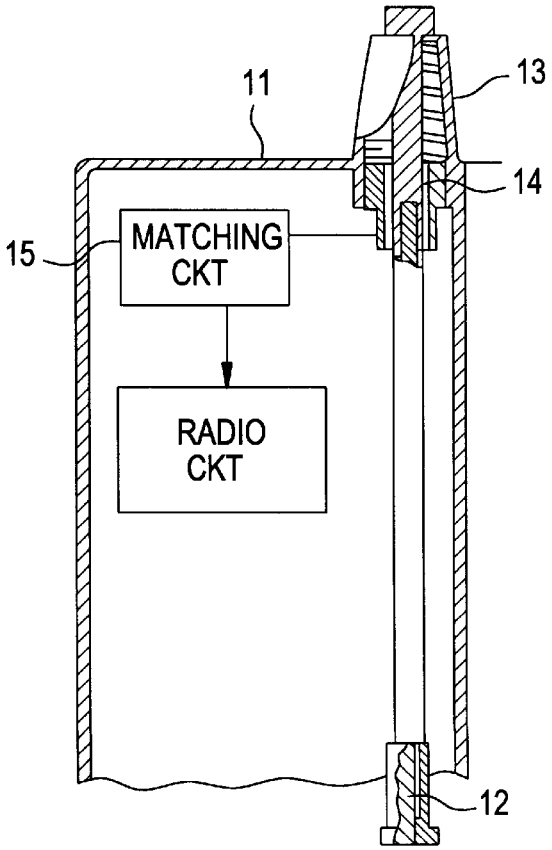
FIG.2B PRIOR ART
FIG. 2B shows the retractable whip antenna of FIG. 2A in its retracted position.

FIGS. 2A and 2B show a conventional retractable whip antenna disclosed in Japanese Patent Laid-Open Publication No. 6-216630 also mentioned earlier. As shown, a retractable whip antenna element 12 is mounted on a casing 11 included in a radio communication apparatus for mobile communication. The whip antenna element 12 extends through a helical antenna element 13 coaxially with the element 13. The whip antenna element 12 is covered with an insulator 14. The reference numeral 15 designates a matching circuit.

When the whip antenna element 12 is extended, power is fed to both of the whip antenna element 12 and helical antenna element 13. When the whip antenna element 12 is retracted deeper than the helical antenna element 13, power is fed only to the helical antenna element 13.

Japanese Patent Laid-Open Publication No. 7-273524 mentioned previously proposes a structure in which a ¼ wavelength helical antenna is affixed to the casing of a portable radio telephone, A ½ wavelength whip antenna retractably extends through a through bore formed at the center of the helical antenna.

The conventional antennas described above each has some problems left unsolved, as discussed earlier.

Figure 3A:
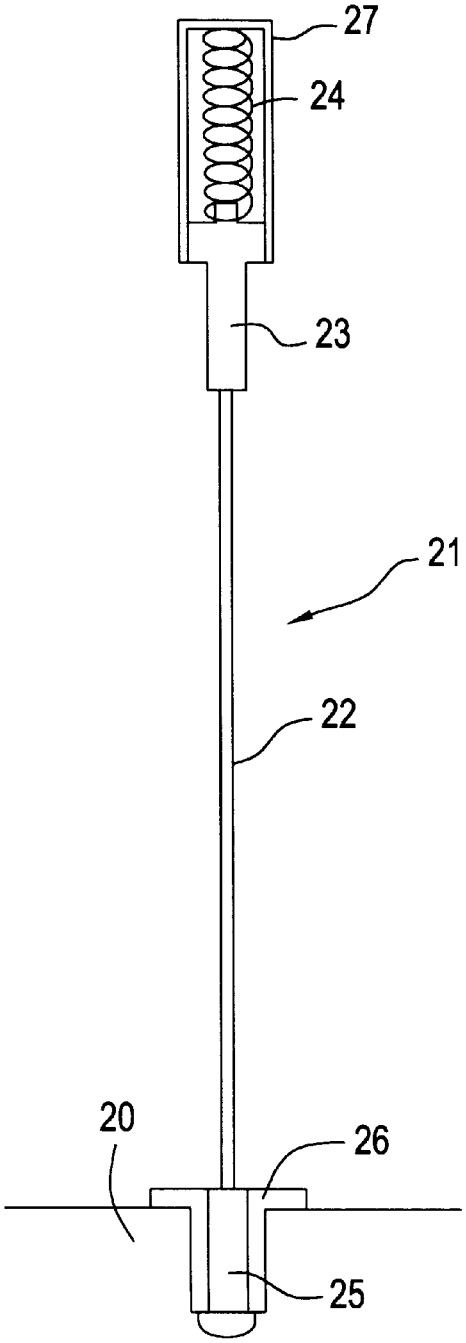
FIG. 3A is a section showing the structure of an antenna embodying the present invention in its extended position.
Figure 3B:
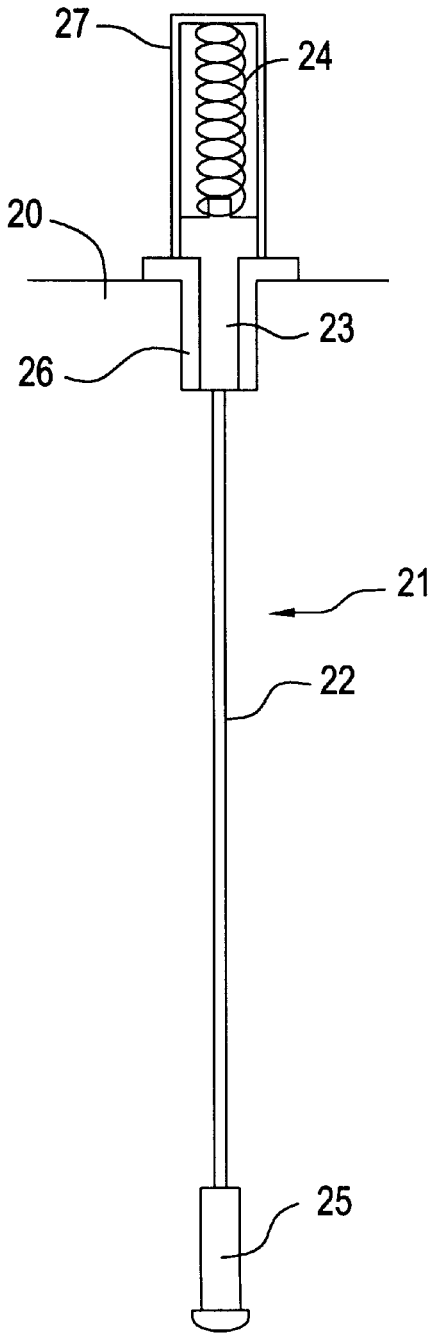
FIG. 3B shows the antenna of FIG. 3A in its retracted position.
Figure 4:
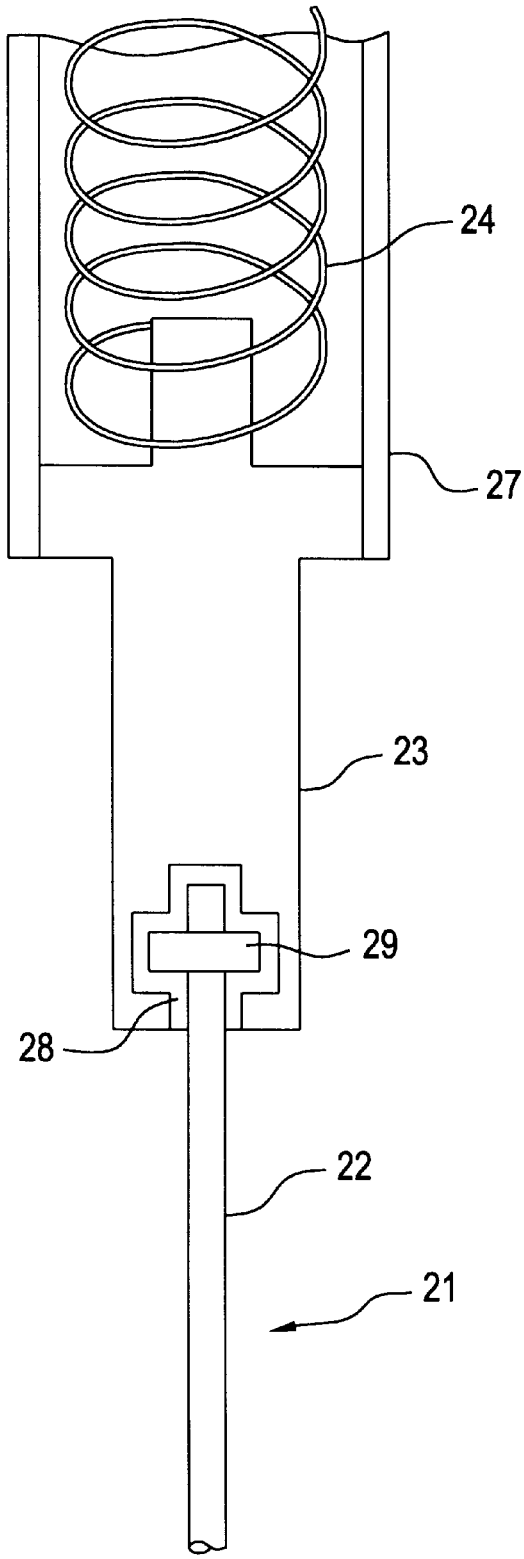
FIG. 4 is a fragmentary enlarged section of the antenna shown in FIGS. 3A and 3B.

Referring to FIGS. 3A, 3B and 4, an antenna structure for a portable radio communication apparatus embodying the present invention is shown. As shown, the radio communication apparatus includes a casing 20 on which a retractable whip antenna 21 is mounted. The whip antenna 21 has an electric length of $\lambda/2$ (½ wavelength). A rod-like straight element 22 constitutes a major part of the whip antenna 21. A helical antenna feed portion 23 is positioned at the tip portion of the whip antenna 21. A helical antenna element 24 is connected to the helical antenna feed portion 23. A whip antenna feed portion 25 is positioned at the bottom of the whip antenna 21. An antenna holder 26 is formed of metal and affixed to the top of the casing 20. The helical antenna element 24 is covered with a cover 27. An insulator 28 is disposed in the helical antenna feed portion 23 for setting up capacitive coupling between the straight element 22 and the helical antenna feed portion 23. The end of the straight element 22 is affixed to the insulator 28 by a metal fitting 29.

Figure 5A:
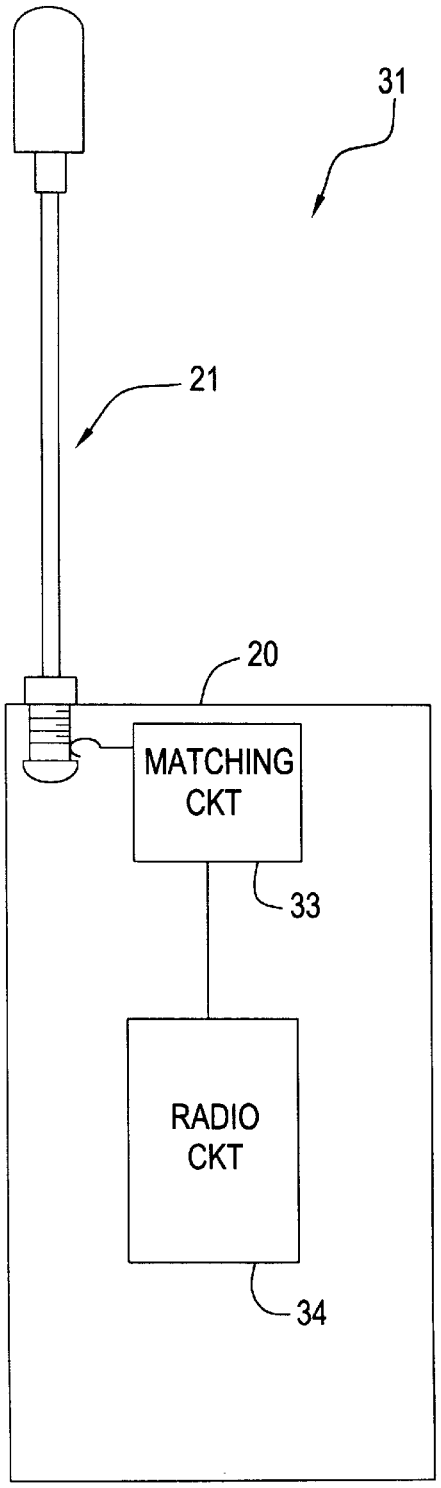
FIG. 5A shows circuitry included in a portable radio communication apparatus on which the antenna of FIGS. 3A and 3B is mounted and held in the extended position.
Figure 5B:
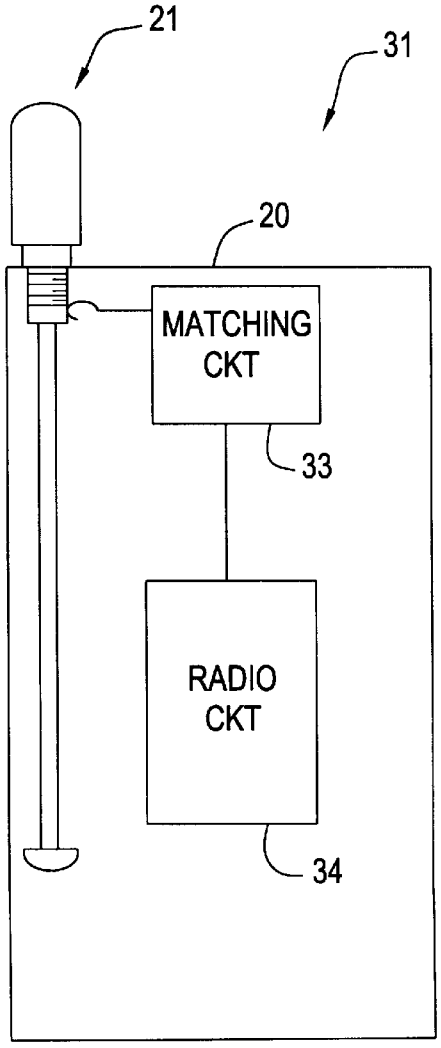
FIG. 5B shows the antenna of FIG. 5A in its retracted position.

As shown in FIGS. 5A and 5B, the casing 20 of the radio communication apparatus, generally 31, has a matching circuit 33 and a radio circuit 34 thereinside. The whip antenna 21 is connected to the radio circuit 34 via the matching circuit 33.

Figure 6B:
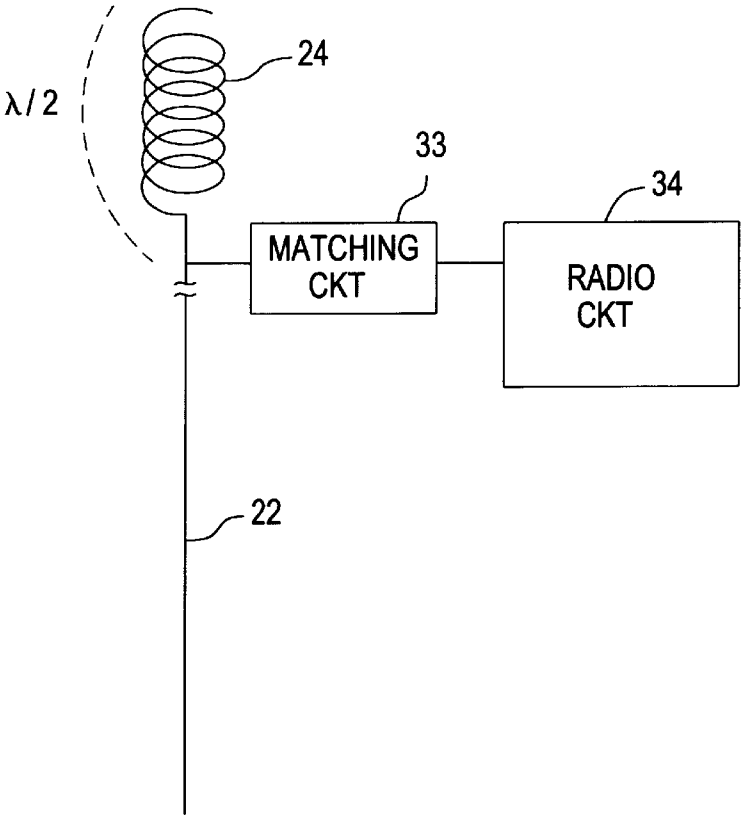
FIGS. 6A and 6B demonstrate the operation of the illustrative embodiment in the extended position and retracted position, respectively.
Figure 6A:
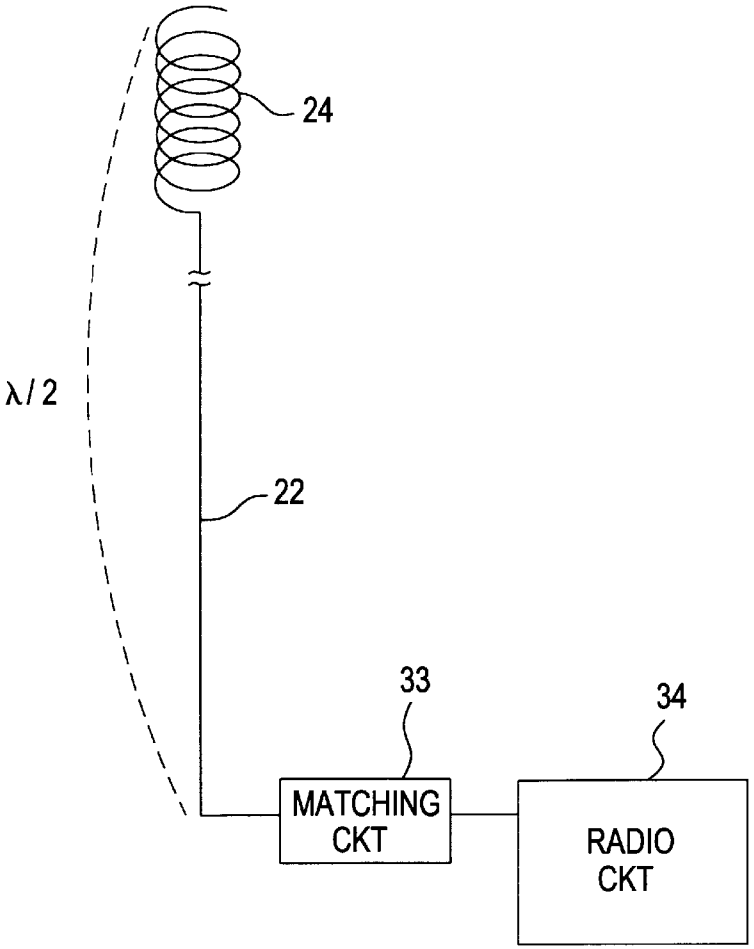

As shown in FIG. 3A, when the whip antenna 21 is extended, power is fed to the straight element 22 via the whip antenna feed portion 25. At this instant, the straight element 22 is connected to the helical antenna feed portion 23 by capacitive coupling. Therefore, by adjusting the amount of such capacitive coupling, it is possible to implement a whip antenna having all overall electric length of $\lambda/2$ and suffering from a minimum of body deterioration, as shown in FIG. 6A. The electric length is adjusted in terms of the amount of coupling between the straight element 22 and the helical antenna feed portion 23. The amount of coupling is, in turn, adjusted on the basis of the amount of insertion of the straight element 22 into the helical antenna feed portion 23 and the dielectric constant of the insulator 28 providing insulation between the element 22 and feed portion 23.

As shown in FIG. 3B, in the retracted position of the whip antenna 21, the straight element 22 is received in the casing 20. At this instant, the straight element 22 is connected to the helical antenna feed portion 23 by capacitive coupling. As a result, the straight element 22 received in the casing 20 is electrically isolated, so that power is fed only to the helical antenna element 24 via the helical antenna feed portion 23. Consequently, as shown in FIG. 6B, only the helical antenna element 24 operates with an electric length of $\lambda/2$.

As stated above, when the whip antenna 21 is extended, the electric length can be adjusted only if the amount of capacitive coupling between the straight element 22 and the helical antenna feed portion 23 is adjusted, i.e., without resorting to the adjustment of the helical antenna element 24. In the retracted position of the antenna 21, the helical antenna element 24 operates alone and allows an optimal dimension implementing a desired resonance frequency and specific frequency band to be used. Further, the antenna 21 turns out a $\lambda/2$ antenna in both of its extended position and retracted position, so that a single matching circuit 33 suffices. This successfully promotes efficient power transfer.

Figure 7A:
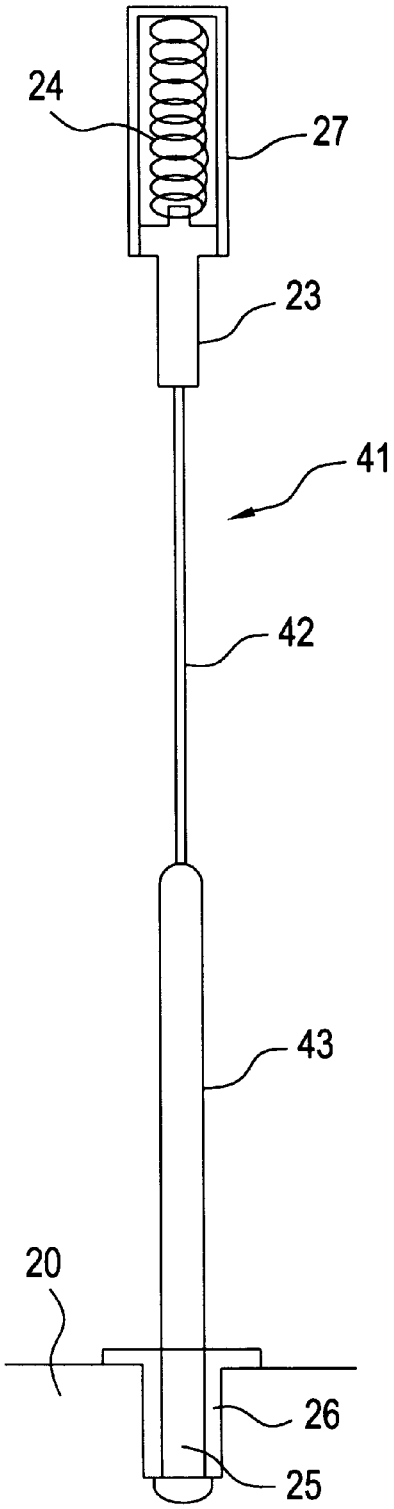
FIGS. 7A and 7B are sections showing an alternative embodiment of the present invention in an extended position and a retracted position, respectively.
Figure 7B:
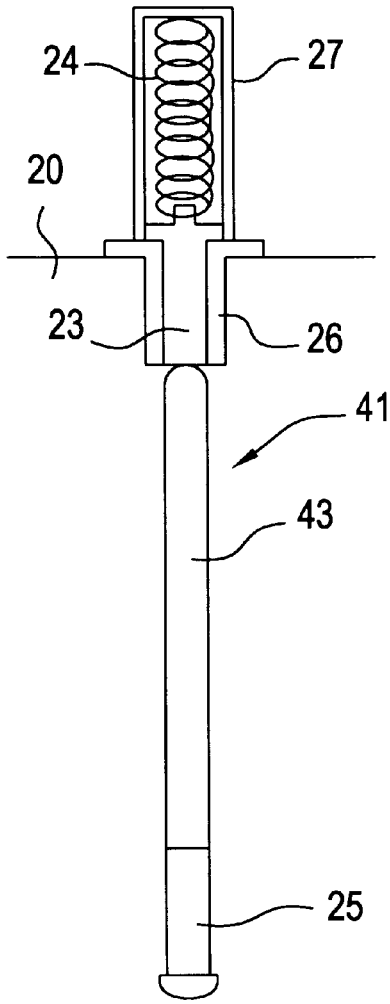
Figure 8:
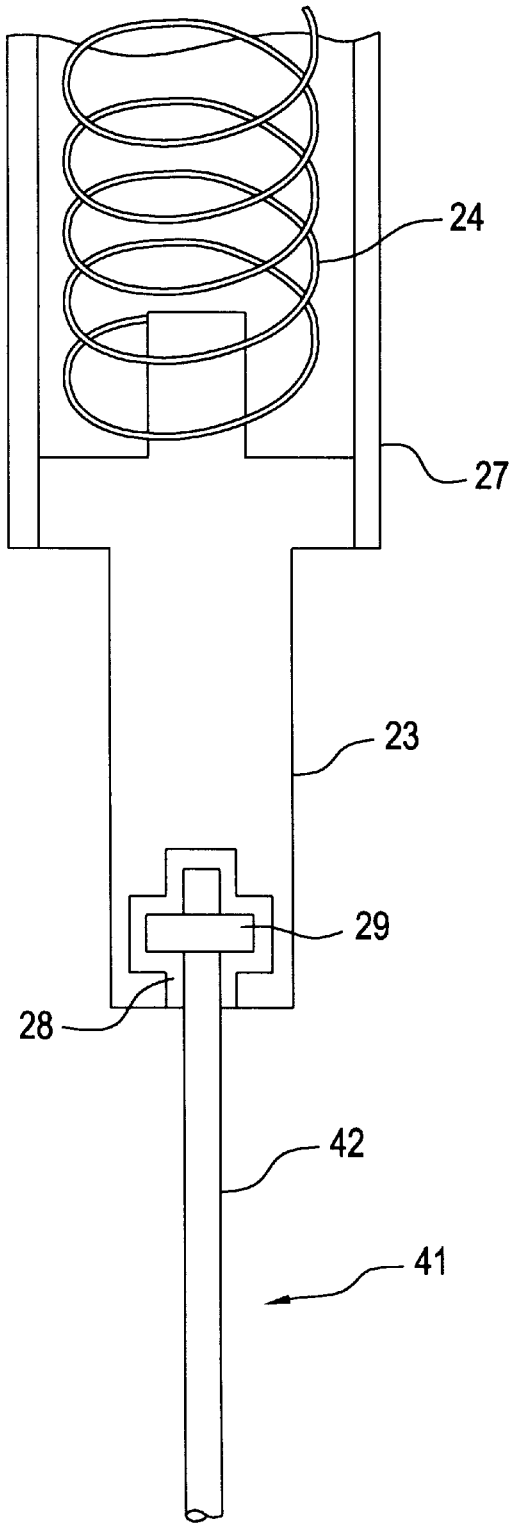
FIG. 8 is a fragmentary enlarged section of the alternative embodiment.

Reference will be made to FIGS. 7A, 7B and 8 for describing an alternative embodiment of the present invention. As shown, this embodiment is implemented as a retractable whip antenna 41 having an electric length of $\lambda/2$. The whip antenna 41 differs from the whip antenna 21 of the previous embodiment in that the straight element 22 is replaced with an upper straight element 42 and a lower straight element 43 telescopically jointed together. When the whip antenna 41 is retracted, the upper straight element 42 is received in the lower straight element 43. When the whip antenna 41 is extended, the lower straight element 43 coaxially connects itself to the upper straight element.

As shown in FIG. 7A, in the extended position of the whip antenna 41, the overall electric length of the antenna 41 , including the lower straight element 43, is adjusted to $\lambda/2$ on the basis of capacitive coupling between the upper straight element 42 and the helical feed portion 23. As shown in FIG. 7B, in the retracted position, the upper straight element 42 is received in the lower straight element 43 which is, in turn, received in the casing 20. In this condition, the telescopic straight element is electrically isolated from the helical antenna feed portion 23, allowing the helical antenna element 24 to be optimally adjusted.

The illustrative embodiment achieves the same advantages as the previous embodiment. In addition, the telescopic arrangement of the two straight elements 42 and 43 allows the length of the entire straight element to be reduced while guaranteeing the electric length of $\lambda/2$. This configuration therefore contributes a great deal to the miniaturization of a portable radio communication apparatus.

In summary, it will be seen that the present invention provides an antenna structure for a portable radio communication apparatus having various unprecedented advantages, as enumerated below.

(1) A whip antenna and a helical antenna feed portion are connected by capacitive coupling via an insulator. Therefore, when the whip antenna is extended, the electric length can be adjusted on the basis of the amount of capacitive coupling between a straight portion and the helical antenna feed portion, i.e., without resorting to the adjustment of a helical antenna element. When the whip antenna is retracted, the straight portion is electrically isolated in order to allow the helical antenna element to operate alone. In this position, the helical antenna element is optimally adjusted in such a manner as to resonate in a desired frequency band.

(2) In both of the extended position and retracted position, the whip antenna has the same electric length and therefore allows a single matching circuit to suffice. This enhances efficient power transfer.

(3) The straight portion is implemented by a rod-like upper straight portion and a lower straight portion. The lower straight portion receives the upper straight portion in the retracted position or coaxially connects itself to the upper straight portion in the extended position. This allows the length of the straight portion to be reduced while guaranteeing the electric length and thereby promotes the miniaturization of a portable radio communication apparatus.

Various modifications will become possible for those skilled in the art after receiving the teachings of the present disclosure without departing from the scope thereof.

What is claimed is:

1. A structure of an antenna for a portable radio communication apparatus, comprising:

a whip antenna retractably mounted on a casing of the portable radio communication apparatus and including a rod-like straight portion;

a helical antenna feed portion positioned on a tip portion of said whip antenna; and a helical antenna connected to said helical antenna feed portion;

said whip antenna and said helical antenna feed portion being coupled by capacitive coupling via an insulator.

2. A structure as claimed in claim 1, wherein said straight portion comprises a rod-like upper straight member and a lower straight member, said lower straight member receiving said upper straight member therein when said whip antenna is retracted, said lower straight member coaxially connecting itself to said upper straight member when said whip antenna is extended.

* * * * *